US007495807B2

(12) United States Patent
Hauck et al.

(10) Patent No.: US 7,495,807 B2
(45) Date of Patent: Feb. 24, 2009

(54) COMMUNICATION SYSTEM

(75) Inventors: Dieter Hauck, Eberbach (DE); Steffen Janz, Waldsee (DE); Achim Scheurer, Bellheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 737 days.

(21) Appl. No.: 09/859,832

(22) Filed: May 17, 2001

(65) Prior Publication Data

US 2001/0043363 A1 Nov. 22, 2001

(30) Foreign Application Priority Data

May 17, 2000 (DE) ..... 100 23 995

(51) Int. Cl.

| | |
|---|---|
| ***H04N 1/32*** | (2006.01) |
| ***H04N 1/333*** | (2006.01) |
| ***H04N 1/42*** | (2006.01) |
| ***H04N 1/21*** | (2006.01) |
| ***G06F 15/173*** | (2006.01) |
| ***G06F 11/30*** | (2006.01) |
| ***G06F 15/16*** | (2006.01) |
| *G06F 3/12* | (2006.01) |
| *G06K 1/00* | (2006.01) |

(52) U.S. Cl. ..... 358/407; 358/1.13; 358/1.15; 358/434; 358/435; 358/438; 358/439

(58) Field of Classification Search ..... 358/1.15
See application file for complete search history.

(56) References Cited

U.S. PATENT DOCUMENTS

| | | | | |
|---|---|---|---|---|
| 5,467,434 | A * | 11/1995 | Hower et al. | 358/1.15 |
| 5,467,436 | A | 11/1995 | Rodi et al. | |
| 5,509,108 | A | 4/1996 | Yeh | |
| 5,580,177 | A * | 12/1996 | Gase et al. | 400/61 |
| 5,625,758 | A | 4/1997 | Schneider et al. | |
| 5,857,074 | A * | 1/1999 | Johnson | 709/217 |
| 5,881,245 | A | 3/1999 | Thompson | |
| 5,982,994 | A * | 11/1999 | Mori et al. | 358/1.15 |
| 5,995,721 | A * | 11/1999 | Rourke et al. | 358/1.15 |
| 6,024,504 | A | 2/2000 | Weichmann et al. | |
| 6,134,669 | A * | 10/2000 | Farago et al. | 713/322 |
| 6,138,178 | A * | 10/2000 | Watanabe | 710/8 |
| 6,424,424 | B1 * | 7/2002 | Lomas et al. | 358/1.14 |
| 6,441,920 | B1 * | 8/2002 | Smith | 358/1.2 |
| 6,498,656 | B1 * | 12/2002 | Mastie et al. | 358/1.15 |
| 6,650,431 | B1 * | 11/2003 | Roberts et al. | 358/1.15 |
| 6,772,420 | B1 * | 8/2004 | Poger et al. | 719/327 |
| 6,915,514 | B1 * | 7/2005 | Machida | 717/174 |
| 6,989,910 | B2 * | 1/2006 | Lomas et al. | 358/1.15 |

(Continued)

FOREIGN PATENT DOCUMENTS

| | | |
|---|---|---|
| CA | 1 223 972 | 7/1987 |

(Continued)

*Primary Examiner*—Twyler L Haskins
*Assistant Examiner*—Myles D Robinson
(74) *Attorney, Agent, or Firm*—Laurence A. Greenberg; Werner H. Stemer; Ralph E. Locher

(57) ABSTRACT

In a communication system, which is used in particular in the production of print media, information coming from an output file is forwarded to a receiving unit. However, this information is not forwarded directly but via a filter unit which has access to the requirements of the receiving unit.

14 Claims, 2 Drawing Sheets

U.S. PATENT DOCUMENTS

| | | | | |
|---|---|---|---|---|
| 7,061,636 | B2 * | 6/2006 | Ryan et al. | 358/1.15 |
| 7,168,003 | B2 * | 1/2007 | Lozano et al. | 714/25 |
| 7,177,037 | B2 * | 2/2007 | Johnson | 358/1.15 |
| 2002/0016818 | A1 * | 2/2002 | Kirani et al. | 709/203 |
| 2002/0065872 | A1 * | 5/2002 | Genske et al. | 709/202 |
| 2002/0071134 | A1 * | 6/2002 | Jackson et al. | 358/1.13 |
| 2002/0135800 | A1 * | 9/2002 | Dutta | 358/1.15 |

FOREIGN PATENT DOCUMENTS

| | | | |
|---|---|---|---|
| DE | 298 02 210 | U1 | 4/1998 |
| DE | 197 24 066 | A1 | 10/1998 |
| EP | 0 158 797 | A2 | 10/1985 |
| EP | 0 395 890 | A2 | 11/1990 |
| EP | 0 639 456 | A1 | 2/1995 |

* cited by examiner

COMMUNICATION SYSTEM

BACKGROUND OF THE INVENTION

Field of the Invention

The invention relates to a system for communication between an output unit and a receiving unit and in particular to a communication system to be used when producing print media. The output unit can generate and/or forward information, especially in the form of a file. The receiving unit can receive at least some of the information. The invention further relates to a method for communication between an output unit and a receiving unit.

When developing new technologies in the printing industry or graphics industry, there is a great need to provide an improved connection between the processes of the pre-press stages, the printing processes, the print post-processing and, if appropriate, job processing. These processes have hitherto mainly been performed separately from one another.

In many systems in the graphics industry, originals are currently produced in many different ways in the pre-press stage. In order to process these originals further, these are digitized, to the extent necessary, and subsequently provided with additional information relating to the page to be printed later. In the process, a so-called imposition scheme is produced, which contains information about the sheets to be printed, in particular about the configuration of the pages of the subsequent end product. This file, which is present in digital form, can furthermore be supplemented by additional information such as the position and length of the cut register marks, color measurement strips or other additional information, which is needed during the subsequent processing of the sheet.

From this file, the color separation file needed for each color to be printed is usually created with the aid of a Raster Imaging Processor (RIP). For reasons of the intended standardization, these color separation files are stored as pixel graphics in a defined data format, at present in the so-called print production format (PPF). These PPF files are then subsequently in turn forwarded to the respective end devices, such as the plate exposer, the printing machine, in particular in the case of so-called direct imaging printing machines, in which the printing plate is exposed in the printing machine. Furthermore, in the printing process it is necessary to calculate the area coverage values of the individual colors from the respective color separation file, which can be carried out either in a separate operation on a dedicated machine or directly from the color separation file in the PPF. With regard to the communication between an output device, such as the RIP, and individual final devices such as one or more printing machines or the apparatus for calculating the color separations, European Patent No. EP 639 456, corresponding to U.S. Pat. No. 5,625,758, discloses a communication system. In this communication system, the data generated at the pre-press stage is communicated to connected printing units with the aid of a file, this file containing all the technically required parameters about the respective job, such as color assignment, formats, paper thickness and the like. Moreover, the file can further be augmented with additional data, which contain the required information relating to the machine couplings, turner apparatus, finishing, powder apparatus, and the color, cut or folding registering. This file is then subsequently forwarded to the respective final devices.

A communication system for transferring information from a central data processing device to a plurality of final devices, for example a plurality of printing machines, is disclosed in European Patent No. EP 395 890. In this case, a central data transmitting and data processing device monitors the production sequence, the printing machine which is available for a new print job being selected, and the data required for the print job being transferred to the printing machine. These data can also contain current production data.

However, a drawback with the known data communication is that the quantity of data which has to be forwarded to the individual final devices, such as the printing machine or the print post-processing machine, is extremely large and, to some extent, contains items of information which are superfluous or redundant for the respective final device. For example, image data are also transmitted to the cutting device, but are not needed by the cutting device. This leads to a considerable loss of time, since a great quantity of unnecessary data has to be read by the individual final devices.

SUMMARY OF THE INVENTION

It is accordingly an object of the invention to provide a system for communication between an output unit and a receiving unit which overcomes the above-mentioned disadvantages of the heretofore-known systems of this general type and which is optimized with regard to time efficiency and speed.

With the foregoing and other objects in view there is provided, in accordance with the invention, a communication system, including:

an output unit for generating and/or forwarding information;

a receiving unit for receiving at least some of the information, the receiving unit having given requirements; and a filter unit connected between the output unit and the receiving unit, the filter unit forwarding data coming from the output unit in accordance with the given requirements of the receiving unit.

Using the filter unit according to the invention, it is then possible to shorten the transmission time of the data between the output and the receiving unit considerably.

In a preferred embodiment of the invention, the output unit is configured as a Raster Imaging Processor, which transmits the information to a filter unit in the form of a so-called Print Production Format (PPF) file. Stored in the filter unit is a large amount of data about the final devices connected to the filter unit, such as a cutting machine, a folding machine or a printing machine. This information, which is stored in a storage area in the filter unit, includes, for example, the type of information needed by the respective final device, or which communication standard has to be complied with in communicating with the respective final device.

The use of the filter unit has a number of advantages which result in particular from the fact that information which is present in the PPF file is forwarded to the final devices only to the extent to which these data are also needed by the respective end devices. Furthermore, it is easily possible to filter out redundant information which is present. In addition, the data format of the information transmitted from the output unit to the filter unit can easily be modernized or reconfigured without it also being necessary to modernize or replace the final devices. In addition, the use of the filter unit according to the invention has the advantage that communication between the output unit and a third-party device can be achieved simply by storing the data typical of the third-party device and needed by it in the filter unit.

According to another feature of the invention, the output unit generates and/or forwards the information as a file.

According to yet another feature of the invention, the output unit generates and/or forwards the information in accordance with a protocol.

According to a further feature of the invention, a plurality of receiving units are connected to the filter unit.

According to yet a further feature of the invention, the filter unit has a storage medium which stores data about the plurality of receiving units.

According to another feature of the invention, the storage medium stores information about a respective standard required by a respective one of the plurality of receiving units.

According to an additional feature of the invention, the storage medium stores information about a respective version of a standard required by a respective one of the plurality of receiving units.

According to another feature of the invention, the storage medium stores information about a respective communication version required by a respective one of the receiving units.

According to yet another feature of the invention, the storage medium stores information about a respective type of data required by a respective one of the receiving units.

According to a further feature of the invention, the storage medium stores information about a respective quantity of data required by a respective one of the receiving units.

According to yet a further another feature of the invention, the filter unit interrogates data about at least one of the receiving units and subsequently stores the data in a volatile manner or a nonvolatile manner.

According to yet another feature of the invention, the filter unit includes a converting device for converting information coming in from the output unit into receiver information in accordance with receiver-related data stored in the storage medium.

According to a further feature of the invention, the filter unit includes an arithmetic processor, the arithmetic processor converts information coming in from the output unit into receiver information in accordance with receiver-related data stored in the storage medium.

According to yet a further feature of the invention, each of the receiving units has a respective dedicated output channel assigned thereto.

According to another feature of the invention, the filter unit includes an arithmetic unit for checking a plausibility of data coming in from the output unit.

With the objects of the invention in view there is also provided, a method for communication between an output unit and a receiving unit, which includes the steps of:

providing a filter unit having access to receiving requirements of a receiving unit; and transmitting, with an output unit, information to the receiving unit by forwarding the information via the filter unit.

Other features which are considered as characteristic for the invention are set forth in the appended claims.

Although the invention is illustrated and described herein as embodied in a communication system and a communication method, especially for the production of print media, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
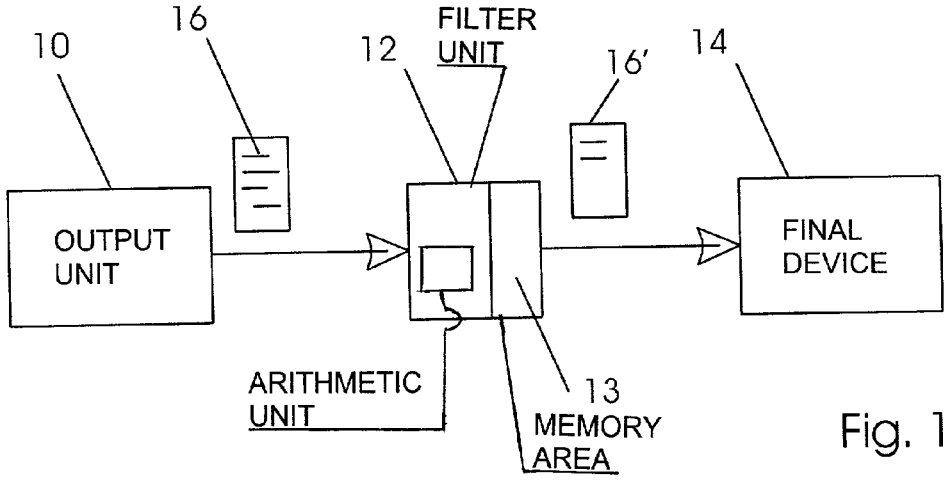
FIG. 1 is a schematic block diagram of a simple case of the system according to the invention.

Referring now to the figures of the drawings in detail and first, particularly, to FIG. 1 thereof, there is shown a simple example of a communication system according to the invention. In this case, an output unit 10 is provided which is capable of generating and/or forwarding information. This output unit may be, for example, a Raster Imaging Processor (RIP), a Print Production System (PPS), an imposition station or a trade-related software package, each of which generates different items of data which are to be forwarded to a final device 14. The final device 14 may be, for example, a printing machine, a folding machine, a cutting machine, a plate exposer or another final device used in the field of the graphics industry. According to the invention, the file 16 coming out of the output station 10 is then not transmitted directly to the final device 14 but fed first of all to a filter unit 12. It is essential to the invention that the filter unit 12 has access to data relating to the receiving unit associated with it. To this end, the filter unit 12 can be configured such that, for example, a memory area 13 is provided in the filter unit, in which the data relevant for the action of forwarding the file 16 to the receiving unit 14 can be stored permanently or in a volatile manner. These data, which are pre-held in the filter units 12 or are at least accessible to it, contain data relating to the connected receiving unit 14 and intended for the requirements which the connected receiving unit 14 has with regard to receiving data. In particular, therefore, the filter unit 12 has available to it data about the receiving unit 14 which relate to the type, quantity, the communications standard to be complied with or the version number of the communication standard.

In a practical configuration of the invention, the output unit 10 may be, for example, an RIP which has received a file from the pre-press stage and converts the file into a bit map file and then feeds it to the filter unit 12 as a file 16. In the filter units 12, the incoming bit map file is analyzed and forwarded to a receiving unit, for example a cutting machine.

It is obvious that the cutting machine does not also have to be supplied with the entire information from the bit map file 16, for example about color separations. Accordingly, it is specifically stored in the filter units 12 for the cutting unit that the cutting unit needs data about the cutting marks. Also stored in the filter units 12 is the data format in which the data 16' are to be forwarded to the cutting unit 14.

Figure 2:
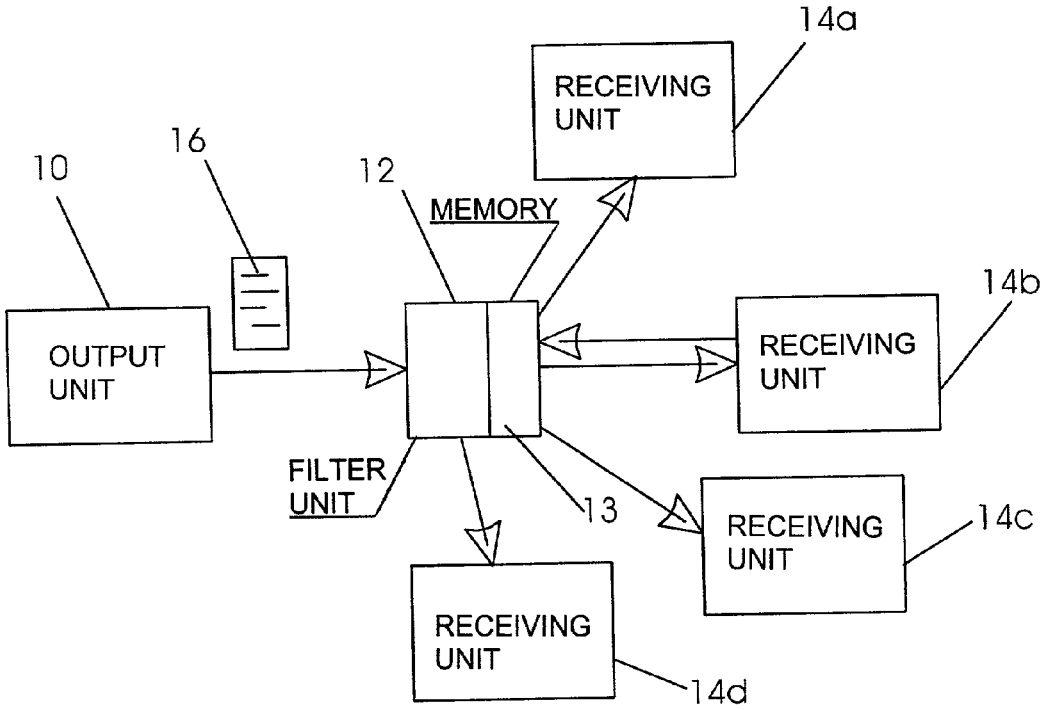
FIG. 2 is a schematic block diagram of the system according to the invention using various devices from the graphics industry.

FIG. 2 shows a further embodiment of the communication system according to the invention. In this case, one filter unit 12 is associated with a plurality of receiving units 14*a*, 14*b*, 14*c*, 14*d*, which can be provided, for example, in a printing machine, a plate exposer, a folding machine, a cutting station or another external device. Of course, a multiplicity of these final devices can also be provided. For each of the devices, the filter unit 12 has access to data which correspond to the requirements for communication with the final devices 14*a* to 14*d*. In particular, these data can again be stored in a nonvolatile or volatile memory 13 belonging to the filter unit 12, so that these data can be used for preparing the incoming file 16.

It is also possible for the filter unit 12 to get into contact with each or one of the connected receiving units 14*a* to 14*d* and, through the use of mutual communication, interrogates the relevant data and subsequently stores the data in a nonvolatile or volatile memory 13 belonging to the filter unit 12, at least for this communication operation.

Using the data stored in the filter unit 12 and relating to the receiving units, a file supplied to the filter unit or a record supplied to the filter unit is modified. During this operation, it is, of course, also possible for algorithms or conditions to be stored in the filter unit 12, with which the treatment or modification of the file 16 is possible while taking special account of the information stored for the respective final device. For example, an incoming file 16 can be transmitted to the filter units 12 in a specific standard, such as the so-called CIP3 (International Cooperation for Integration of Prepress, Press, and Postpress) standard or the PJTF (Portable Job Ticket Format). If specific items of information from this file are to be forwarded to one of the final devices 14*a* to 14*d*, then a check is made to see which communication standard is to be complied with during communication with a respective final device. The file is modified accordingly before the communication between the filter unit 12 and the final device, so that this standard can be complied with.

Furthermore, if required, specific items of information can also be filtered out from the file 16, in order to transfer to the receiving device only the information which the latter actually needs. In particular, thought can be given to separating out data relevant for printing machines, such as the position of the pixels in the color separation, from the file if the latter is transmitted to a cutting device, or to transmitting only the position of the cutting marks to the cutting device. In addition to this data filter function, as it is known, provision can also be made for the data filter units 12 to perform a "routing function," that is to say that the data filter unit 12 decides, by using the incoming data 16, for which of the connected final devices these data are suitable and intended.

Figure 3:
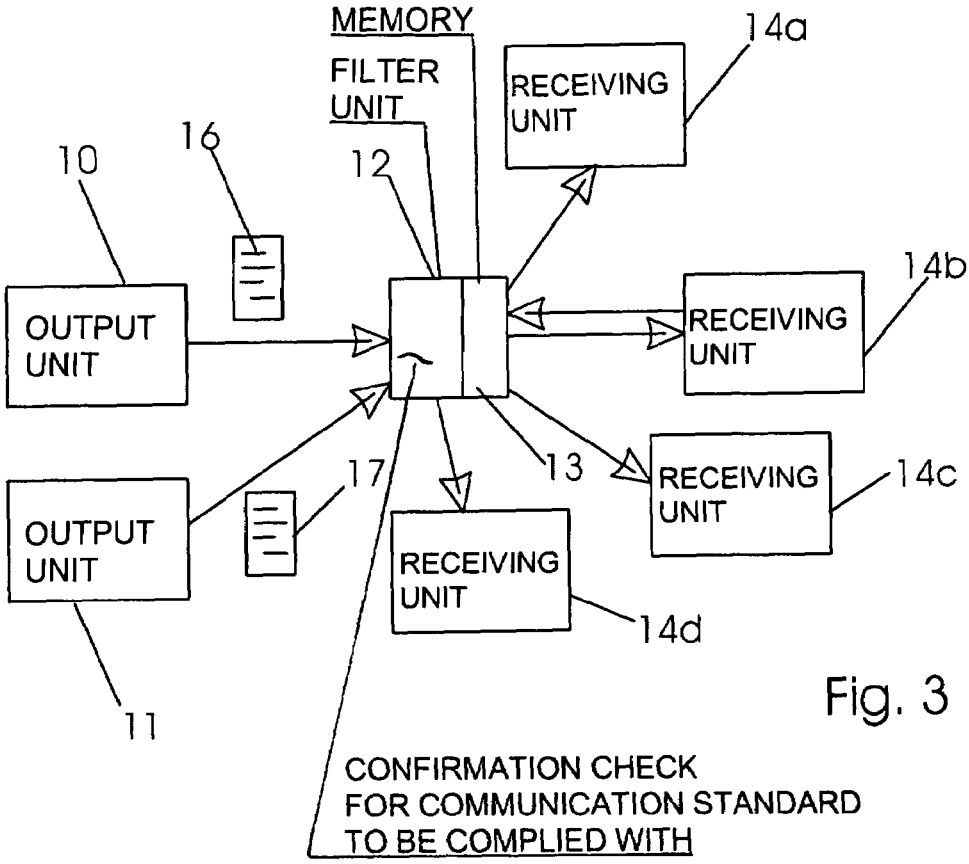
FIG. 3 is a schematic block diagram of the system according to the invention with a number of output units.

FIG. 3 shows a further embodiment of the invention, in which two output units 10, 11 are provided, which each forward items of information, in particular in the form of a file, a protocol or a record 16, 17, to a filter unit 12.

In this case, it is possible for the output units 10 and 11 to transmit redundant data to the filter unit 12, so that, at least to some extent, data which is transmitted to the filter units 12 is present in duplicate. In this case, the output unit 10 could, for example, contain the data on job name, job number, cutting and folding marks and values for the inking zone setting, while the output unit 11 transmits job name, job number, date and the name relating to which operation this is to the filter unit 12. Of particular importance here is the fact that the output unit 10 and the output unit 11 can transmit data of different origin, so that, for example, from the output unit 10, substantially technical data and, in the output unit 11, substantially job-related data are forwarded to the filter unit 12. The items of data coming from the different output units can, of course, also be transmitted to the filter unit 12 in different standards. In the filter unit 12, these data can be stored either unchanged or in a suitable data format. Furthermore, it is also possible to link the individual files 16 and 17 with one another in a suitable manner as soon as these data have been input, wherein in particular redundant information is eliminated.

The action of forwarding the information to one of the connected final devices can be carried out via various techniques. In this case, particular consideration is given to time-based or event-based control, so that when a specific instant in time or a specific event occurs, the respectively necessary data are forwarded to the final device in the correct format.

In addition, this forwarding action can further be made dependent on various conditions. In particular, for the case in which there are not just two but a plurality of output units, which forward files to the filter unit in each case, the action of forwarding the suitable information from the filter unit 12 to the respective final device can be made dependent on whether all the items of information relating to a job have been input from specific output units.

Because of the multitude of possible control mechanisms, reference is simply made generally here to the push-and pull techniques which are generally known in data processing.

We claim:

1. A communication system, comprising:

an output unit for at least one of generating and forwarding information;

a receiving unit for receiving at least some of the information, said receiving unit having given requirements; and a filter unit connected between said output unit and said receiving unit, said filter unit configured for forwarding the information coming from said output unit in accordance with the given requirement of said receiving unit and only to an extent to which the information is needed by said receiving unit,the extent being only a portion of the information coming from said output unit, said filter unit storing data about said receiving unit relating to a type, quantity, a communications standard complied with or a version number of the communication standard, and said filter unit being configured for making a check for confirming which communication standard is to be complied with during communication with said receiving unit; and further receiving units connected to said filter unit.

2. The communication system according to claim 1, wherein said output unit at least one of generates and forwards the information as a file.

3. The communication system according to claim 1, wherein said output unit at least one of generates and forwards the information in accordance with a protocol.

4. The communication system according to claim 1, wherein said filter unit has a storage medium, said storage medium stores data about said receiving unit and said further receiving units.

5. The communication system according to claim 4, wherein said filter unit interrogates data about at least one of said receiving unit and said further receiving units and subsequently stores the data in one of a volatile manner and a nonvolatile manner.

6. The communication system according to claim 4, wherein said filter unit includes a converting device for converting information coming in from said output unit into receiver information in accordance with receiver-related data stored in said storage medium.

7. The communication system according to claim 4, wherein said filter unit includes an arithmetic processor, said arithmetic processor converts information coming in from said output unit into receiver information in accordance with receiver-related data stored in said storage medium.

8. The communication system according to claim 1, wherein said filter unit has a storage medium, said storage medium stores information about a respective standard required by a respective one of said receiving unit and said further receiving units.

9. The communication system according to claim 1, wherein said filter unit has a storage medium, said storage medium stores information about a respective version of a standard required by a respective one of said receiving unit and said further receiving units.

10. The communication system according to claim 1, wherein said filter unit has a storage medium, said storage medium stores information about a respective type of data required by a respective one of said receiving unit and said further receiving units.

11. The communication system according to claim 1, wherein said filter unit has a storage medium, said storage medium stores information about a respective quantity of data required by a respective one of said receiving unit and said further receiving units.

12. The communication system according to claim 1, wherein each of said receiving unit and said further receiving units has a respective dedicated output channel assigned thereto.

13. The communication system according to claim 1, wherein said filter unit includes an arithmetic unit for checking a plausibility of data coming in from said output unit.

14. A method for communication between an output unit and a receiving unit, the method which comprises:

providing a filter unit having access to receiving requirements of the receiving unit;

transmitting, with the output unit, information to the receiving unit by forwarding the information in accordance with the given requirements of the receiving unit via the filter unit and only to an extent to which the information is needed by the receiving unit, the extent being only a portion of the information transmitted by the output unit;

storing data in the filter unit about the receiving unit which relate to a type, quantity, a communications standard complied with or a version number of the communication standard;

making a check with the filter unit for confirming which communication standard is to be complied with during communication with the receiving unit;

operating the receiving unit based on the appropriate communication standard; and providing further receiving units connected to said filter unit.

* * * * *